United States Patent [19]

McGowan

[11] 4,211,399

[45] Jul. 8, 1980

[54] MULTIPLE SIZE PLATE REGISTRATION APPARATUS AND METHOD

[75] Inventor: Norman L. McGowan, Romoland, Calif.

[73] Assignee: Eocom Corporation, Tustin, Calif.

[21] Appl. No.: 914,283

[22] Filed: Jun. 9, 1978

[51] Int. Cl.[2] ..... B65H 9/04; B65H 9/06; B65H 9/08

[52] U.S. Cl. ..... 271/232; 101/242; 198/345; 271/236; 271/239; 271/245; 271/250; 271/276

[58] Field of Search ..... 271/232, 236, 239, 238, 271/237, 234, 235, 253, 226, 245, 246, 250, 276, 197; 101/242; 198/345, 809

[56] References Cited

U.S. PATENT DOCUMENTS

| | | | |
|---|---|---|---|
| 250,304 | 11/1881 | Viellemaro | 271/232 |
| 3,195,887 | 7/1965 | Bean | 271/235 X |
| 3,198,517 | 8/1965 | Martin | 271/276 X |
| 3,688,690 | 9/1972 | Gabbrielli | 271/236 X |

*Primary Examiner*—Bruce H. Stoner, Jr.

*Attorney, Agent, or Firm*—Flehr, Hohbach, Test, Albritton & Herbert

[57] ABSTRACT

Multiple size plate registration system having a platen with a top planar surface. Channels are formed in the platen and open through the top planar surface. Parallel grooves are formed in the platen spaced transversely of the platen, extending longitudinally of the platen and opening through the top planar surface. Endless belts travel in the grooves and are used for advancing a plate onto the planar surface of the platen. First and second stop pins are mounted in the platen and are extendable above the top planar surface. Controls are provided for causing the stop pins to be selectably movable between retracted positions below the top planar surface and extended positions above the top planar surface. A guide is carried by the top surface of the platen and extends longitudinally of the platen on one side of the planar surface. Controllable snubbers are provided for snubbing a plate on the planar surface of the platen against the guide and against any one of said first and second stop pins extending above said surface so as to make it possible to precisely register at least two different sizes of plates on said planar surface.

8 Claims, 3 Drawing Figures

MULTIPLE SIZE PLATE REGISTRATION APPARATUS AND METHOD

BACKGROUND OF THE INVENTION

In Laserite (trademark) plate making systems of the type manufactured and sold by EOCOM Corporation of Irvine, California and as disclosed in United States Application for Letters Patent, Ser. No. 758,250, filed Jan. 10, 1977, there is apparatus disclosed which is capable of registering plates of one size. A need has arisen to provide such apparatus which is capable of precisely registering plates of more than one size. There is therefore need for an improved Laserite plate making system.

SUMMARY OF THE INVENTION AND OBJECTS

The multiple size plate registration apparatus comprises a platen having a top planar surface. Channels are formed in the platen and open through the top planar surface. Parallel grooves are formed in the platen spaced transversely of the platen, extending longitudinally of the platen and opening through the top planar surface. Endless belts are provided which travel in the grooves for carrying a plate onto the planar surface. First and second stop pins are mounted on the platen and are extendable above the top planar surface. Means is provided for causing the stop pins to be selectably movable between a retracted position below said planar surface. Guide means is mounted on the planar surface and extends longitudinally of the platen on one side of the planar surface. Snubbing means is provided for snubbing a plate on the planar surface of the platen against guide means and against any one of said pins extending above the surface thereby permitting precise registration of at least two different size plates on said planar surface.

In general, it is an object of the present invention to provide a multiple size plate registration apparatus and method which makes it possible to precisely register two or more plates of different sizes.

Another object of the invention is to provide an apparatus and method of the above character in which the registration is carried out automatically.

Another object of the invention is to provide an apparatus and method which is relatively inexpensive to implement.

Additional objects and features of the invention will appear from the following description in which the preferred embodiments are set forth in detail in conjunction with the accompanying drawings.

DESCRIPTION OF THE PREFERRED EMBODIMENT

Figure 1:
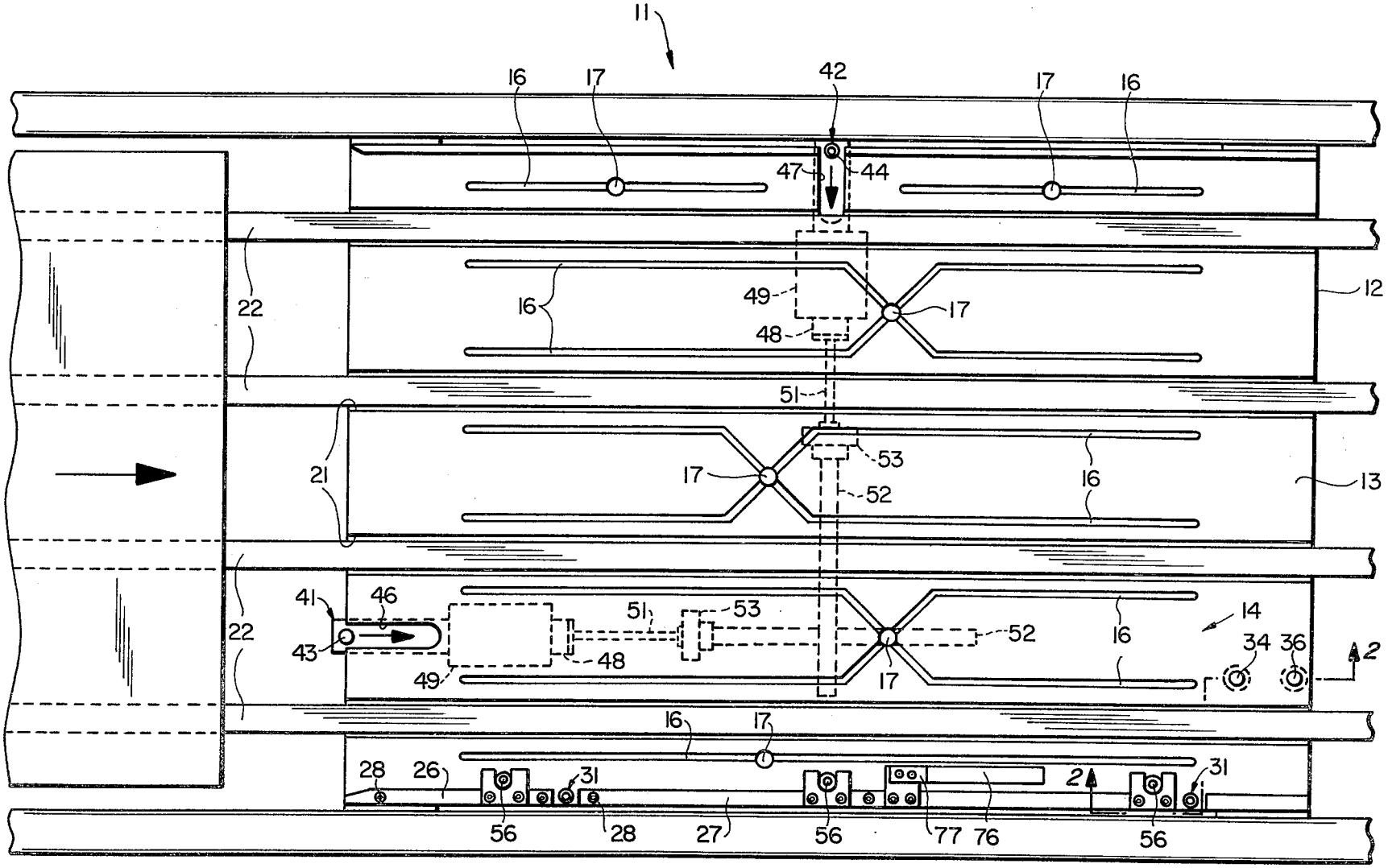
FIG. 1 is a plan view of a multiple size plate registration apparatus incorporating the present invention.

As shown in FIG. 1, the multiple size plate registration apparatus consists of a platen assembly 11 which, for example, can be a write platen assembly of the Laserite plate making system manufactured by EOCOM Corporation of Irvine, California and of the type disclosed in copending application Ser. No. 758,250, filed Jan. 10, 1978, The platen assembly consists of a platen 12 formed of a suitable material such as an aluminum casting which is provided with a planar top surface 13. The top planar surface 13 is ground flat to within a small tolerance.

A plurality of sets 14 of channels 16 are provided in the platen 12 and open through the top surface 13. The sets of channels extend longitudinally of the planar surface and are spaced apart transversely of the top surface. Each of the sets comprises channels 16 which extend into bores 17. The bores 17 are connected into a manifold (not shown) which is connected to a suitable source of vacuum as, for example, a vacuum pump. Controls (not shown) are provided so that a vacuum can be selectably applied to the channels 16 to hold down a plate on the planar top surface 13 as hereinafter described.

A plurality of grooves 21 are provided in the platen 12. Four such grooves are provided and they extend longitudinally of the platen the entire length of the platen. They are also parallel and are spaced transversely of the platen. The grooves 21 extend through the planar top surface 13 and are generally U-shaped in cross section. Endless belts 22 having a width slightly less than the width of the grooves 21 travel in the grooves 21. The upper run of the belts during travel through the grooves extend slightly above the top surface 13 and are used for transporting plates onto the platen 12 as hereinafter described. At an appropriate time, a belt depressor assembly (not shown) is activated by suitable means such as air cylinders to push the belts down on the forward end of the platen to permit a plate to be pulled down and held on the platen 12 by the establishing of a vacuum condition in the channels 16.

Guide means is provided on the platen 12 on the right side of the platen and consists of a rear right guide member 26 and a front guide member 27 which are secured to the top surface of the platen 13 by suitable means such as cap screws 28. A plurality of at least two guide rollers 29 are also provided and form a part of the guide means and establish a guide line along with the guide members 26 and 27 on the right hand side of the platen, as viewed from the rear of the platen. The guide rollers 29 are carried by mounting assemblies 31 mounted upon the platen 12, which are of the eccentric type which can be utilized for adjusting the position of the guide rollers 29 with respect to the guide members 26 and 27.

Figure 2:
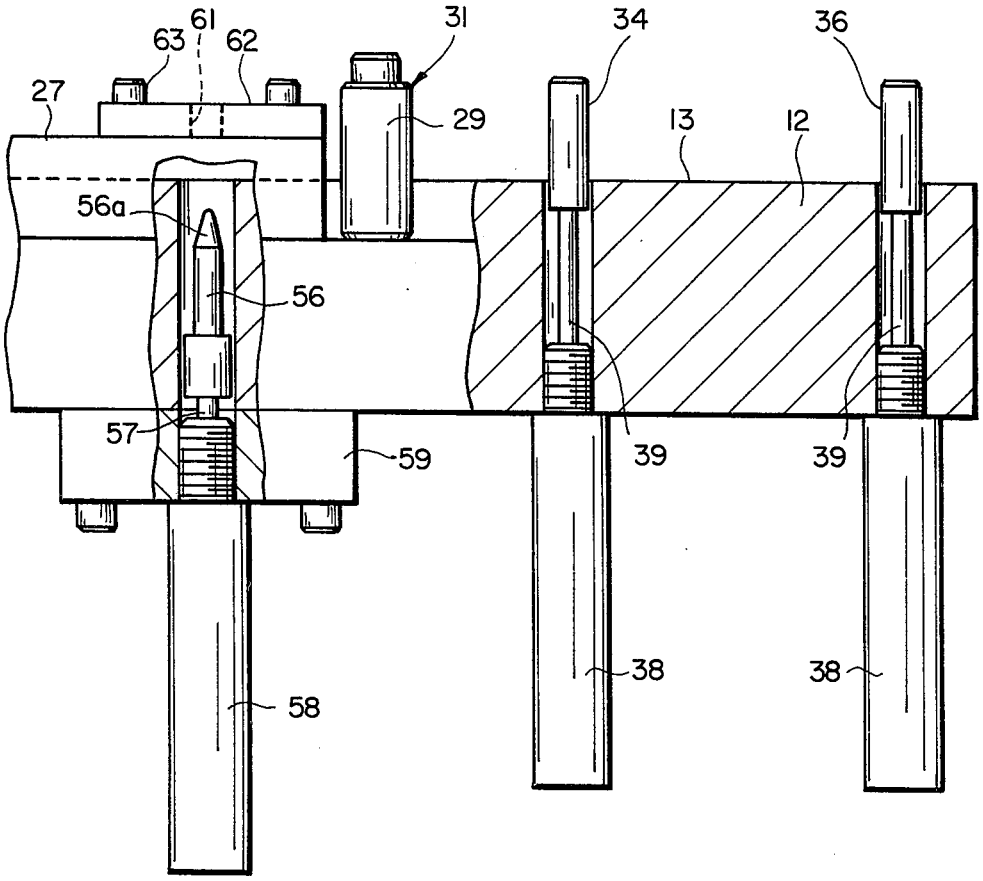
FIG. 2 is a cross sectional view taken along the line 2—2 of FIG. 1.

First and second stop pins 34 and 36 form a part of the platen assembly 11 and are provided for arresting movement of a plate being advanced onto the platen assembly by movement of the belts 22 for registration purposes as hereinafter described. As can be seen, the stop pins 34 and 36 are mounted adjacent the forward extremity of the platen 12 with the stop pin 34 positioned a predetermined distance to the rear of the stop pin 36. As can be seen, the stop pins 34 and 36 are extendable up through the planar top surface 13. Means is provided for causing the stop pins to be movable between a retracted position below the planar top surface and a position above the planar surface and consists of air cylinders 38 which are secured to the bottom side of the platen and which are provided with plungers or piston rods 39 that are pivotally connected to the registration pins 34 and 36 as particularly shown in FIG. 2. The air cylinders 38 can be controlled by manual switches or by automatic switching means of a type well known to those skilled in the art for controlling the movement of the pins 34 and 36 between extended and retracted positions. In the extended position, as shown in FIG. 2, the stop pins 34 and 36 are positioned a substantial distance above the top planar surface 13 so that they are capable of arresting movement of a plate off of the top surface and in a retracted position, as shown in broken lines in FIG. 2, are movable so that their top extremities are below the top planar surface 13.

Means is provided as a part of the platen assembly for snubbing a plate on the platen 12 into engagement with the selected stop pins 34, 36 and into engagement with the guide rollers 29 and/or the guide members 26 and 27. This snubbing means consists of snubber assemblies 41 and 42, with snubber assembly 41 being a rear snubber assembly and snubber assembly 42 being a side snubber assembly. Each of the snubber assemblies includes a snubbing member 43 which can be in the form of a roller or a rigid member formed of a suitable material such as rubber. This snubbing member 43 is positioned so that it extends slightly above the top planar surface 13 so that it is adapted to engage the plate on the planar top surface 13. The snubbing member 43 is carried by post 44 which is adapted to travel in a U-shaped slot 46 for the rear snubber assembly 41 and in a U-shaped slot 47 for the side snubber assembly 42. The post 44 is carried by a slide 48 which is slidably mounted in a bracket 49 secured to the lower side of the platen 12. The slide 48 is connected to a piston rod 51 of an air cylinder assembly 52. The air cylinder assembly 52 is carried by a bracket 53 secured to the lower side of the platen 12.

The plates which are normally to be used in connection with the platen assembly 11 are provided with pre-punched registration holes. Means is provided in connection with the platen assembly for engaging these pre-punched holes and consists of at least two registration pins 56. As can be seen from FIG. 2, the registration pins are provided with a tapered upper end portion 56*a*. The pins 56 are mounted upon piston rods 57 carried by air cylinders 58. The air cylinders 58 are carried by mounting plates 59 secured to the bottom of the platen 12. As shown, the registration pins are movable between a retracted position as shown in FIG. 2 and an extended position which extend above the top planar surface 13. The registration pins also travel through a U-shaped slot 61 provided in a restrictor plate secured to the platen 12 by cap screws 63. The plate is advanced onto the planar top surface 13 and underlies the restrictor plate 62 which prevents upward movement of the plate when the registration pin 56 is being moved upwardly to engage the registration hole provided in the plate.

Figure 3:
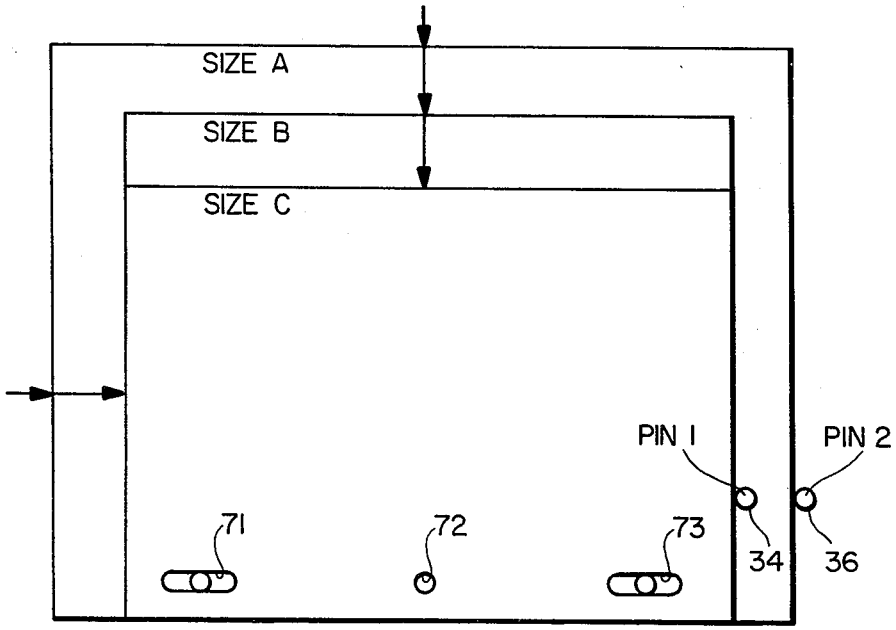
FIG. 3 is a schematic plan view illustration of the manner in which three different size plates can be registered by utilization of two separate pins.

Operation and use of the multiple size plate registration apparatus in performing the present method may be briefly described in conjunction with FIG. 3. As shown in FIG. 3, the apparatus can be utilized for registering plates of three different sizes with these sizes being designated as sizes A, B and C as shown in the drawing and with each of the plates having three registration holes 71, 72 and 73 disposed along the right hand margin of the same. As shown, two of the plates having size B and C have the same length, but are of different widths, whereas size A is of a different length and a different width. The operator in utilizing the apparatus selects the size of plate which is to be utilized and sets up the apparatus so as to accommodate the particular plate size which has been selected. This causes pin 34 or pin 36 to be raised so that it extends above the top planar surface 13. Let it be assumed that it is desired to utilize plates of size A. When this is the case, pin number 34 is retained in a depressed position and pin number 36 is raised. The plate is advanced onto the top planar surface by the belts 22 traveling in the grooves 21 and forward movement of the plate is continued until it engages the stop pin 36. As soon as this occurs, the rear and side snubber assemblies 41 and 42 are actuated to firmly position the plate against the stop pin 36 and also position the same against the guide rollers 29 and/or the guide members 26 and 27. The snubber assemblies 41 and 42 can be operated individually or simultaneously, if desired, although it may be preferable to first actuate one snubber assembly and then to actuate the other snubber assembly.

As soon as the snubber assemblies have positioned the plate against the stop pin 36 and against the guide rollers 29, the registration pins 56 are actuated so that they will pop up through the pre-punched registration holes 71, 72 and 73 in the plate. The registration pins 56 are tapered as hereinbefore described and are able to enter the pre-punched holes in the plate and to precisely position the plate on the platen assembly. As soon as the plate has been precisely registered, the belt lowering assembly (not shown) can be operated to depress the belts 22 into the grooves 21. Thereafter, a vacuum can be applied to the channels 16 to cause the plate to come into firm frictional engagement with the top surface of the platen and to hold the same into place during the time the plate is being exposed in the Laserite apparatus.

An exposure wedge 76 is mounted on a bracket 77 and is adapted to overlie the right side margin of the plate to be exposed. The wedge as is well known to those skilled in the art is utilized for checking the exposure levels on the plate. The plate as it moves onto the planar top surface moves under the exposure wedge 76.

As soon as the exposure has been completed, the vacuum condition can be relieved, the stop pin 36 can be retracted and the belts 22 raised to come into engagement with the plate to advance the plate off the exposure platen 12 and to bring the next plate into position so that the same sequence of steps can be repeated.

Now let it be assumed that it is desired to utilize a plate of a different size such as size B in the Laserite apparatus. When this is the case, the pin 34 is operated so that it is raised above the surface and the plate is advanced into engagement with this pin rather than the pin 36 with respect to a plate having a size A. The same general sequence of operations is performed. The snubber assemblies 41 and 42 are utilized to bring the plate of size B into firm engagement with the stop pin 34 and the side guide rollers 29. When exposure has been completed in the manner hereinbefore described, the stop pin 34 can be moved to its depressed position, and the plate can be moved off of the platen. Similarly, when a plate of size C is utilized, the stop pin 34 is again utilized because that plate has the same length as the plate of size B although it has a greater width. The snubber assemblies can then be utilized to again position the plate of size C and to accomplish the same sequence of operations as hereinbefore described.

From the foregoing it can be seen that there has been provided a multiple size plate registration apparatus and method which makes it possible to accomodate at least three different sizes of plates with two stop pins. It should be readily appreciated that the apparatus can be modified to accommodate still additional plates having different lengths by providing additional stop pins. It also should be appreciated that, if desired, the apparatus could be substantially completely automated whereby the operator merely by selecting a button to determine the plate size could cause automatic operation in an appropriate sequence of the various steps required to obtain precise registration of any particular size of plate in the Laserite apparatus. Such controls have not been described in detail because such controls could be readily implemented by one skilled in the art.

What is claimed is:

1. In a multiple size plate registration apparatus for precisely registering plates, a platen having a planar surface of an area which is sufficiently large to support only one of said plates at a time, channels formed in the platen and opening through said planar surface in area of said platen which would be covered by any one of said plates, grooves formed in the platen spaced transversely of the platen, extending longitudinally of the platen and opening through the top planar surface, endless belts traveling in the grooves for carrying a plate onto the planer surface, first and second stop pins mounted in the platen on the forward extremity of the same, means for causing said stop pins to be selectively movable between a retracted position below said planar surface and an extended position above said planar surface, guide means extending longitudinally of the platen on one side of the platen and snubbing means for snubbing a plate on said platen against said guide means and against any one of said first and second pins extending above said surface whereby at least two different sizes of plates can be precisely positioned on said platen and means for supplying a vacuum to the grooves after the plate has been precisely positioned on the platen to permit operations to be carried out on the plate.

2. Apparatus as in claim 1 wherein said plates are of a type which have pre-punched registration holes together with registration pins slidably mounted in said platen and means for moving said registration pins between retracted positions below said top planar surface and extended positions extending above said top planar surface and adapted to extend through the pre-punched registration holes in the plate.

3. Apparatus as in claim 1 wherein said snubbing means includes first and second snubbing assemblies with one of the snubbing assemblies mounted to the rear of the platen and the other of the snubbing assemblies mounted on the side of the platen assembly remote from the guide means.

4. Apparatus as in claim 1 wherein said means for causing said stop pins to be selectably movable includes an actuator for each of said stop pins.

5. In a method for registering multiple sizes of plates on a planar surface of a platen having first and second stop pins mounted therein with each being movable between a retracted position below the planar surface and a position above the planar surface and having a side guide, selectably positioning one of said stop pins to a position above the surface in accordance with a plate to be positioned on the platen, advancing a plate onto the platen and into engagement with the stop pin which has been raised above the surface, snubbing the plate against the stop pin and against the side guide for registering the plate, applying a vacuum to the plate to hold it firmly in place after it is registered, performing additional operations on the plate while it is held in place under a vacuum, retracting the stop pin and advancing the plate off of the platen.

6. A method as in claim 5 together with the step of positioning the other stop pin so it is in a position above the top surface, advancing a plate of a different size onto the platen in engagement with the other stop pin, snubbing the plate of a different size in engagement with the guide means and the other stop pin performing additional operations on the additional plate, retracting the other stop pin and advancing the additional plate off of the platen.

7. A method as in claim 6 wherein the plates are provided with pre-punched registration holes together with the step of advancing registration pins through the pre-punched holes in the plate after the plate has been snubbed into position to precisely position the plate on the platen.

8. A method as in claim 5 wherein the plate is advanced above the surface of the platen and is thereafter lowered onto the platen.

* * * * *